US008006855B2

(12) United States Patent
Lapoint, III

(10) Patent No.: US 8,006,855 B2
(45) Date of Patent: Aug. 30, 2011

(54) INTERNAL TRUSS SYSTEM FOR SEMI-RIGID CONTAINERS

(75) Inventor: John Lapoint, III, Kennebunk, ME (US)

(73) Assignee: Wrangler Corporation, Auburn, ME (US)

( * ) Notice: Subject to any disclaimer, the term of this patent is extended or adjusted under 35 U.S.C. 154(b) by 757 days.

(21) Appl. No.: 11/333,879

(22) Filed: Jan. 18, 2006

(65) Prior Publication Data

US 2007/0164023 A1 Jul. 19, 2007

(51) Int. Cl.

| | |
|---|---|
| ***B65D 30/10*** | (2006.01) |
| ***B65D 33/02*** | (2006.01) |
| ***B65D 25/00*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 25/14*** | (2006.01) |
| ***B65D 35/14*** | (2006.01) |
| ***B65D 90/10*** | (2006.01) |
| ***B65D 3/00*** | (2006.01) |
| ***B65D 5/56*** | (2006.01) |
| ***A45C 7/00*** | (2006.01) |
| ***A45C 13/04*** | (2006.01) |
| ***A45C 13/26*** | (2006.01) |

(52) U.S. Cl. ..... 220/9.4; 220/9.1; 220/9.2; 220/9.3; 220/676; 220/908.1; 220/495.11; 229/117.35

(58) Field of Classification Search ..... 220/6, 9.1, 220/9.2, 9.3, 9.4, 639, 645, 646, 647, 648, 220/651, 652, 653, 654, 657, 676, 908.1, 220/495.11; 229/117.33, 117.34, 117.35
See application file for complete search history.

(56) References Cited

U.S. PATENT DOCUMENTS

| | | | | |
|---|---|---|---|---|
| 3,194,471 | A | 7/1965 | Murphy | |
| 3,385,504 | A | 5/1968 | Adams | |
| 3,865,269 | A * | 2/1975 | Coleman | 220/6 |
| 3,883,065 | A * | 5/1975 | Presnick | 206/521 |
| 4,426,015 | A * | 1/1984 | Preston et al. | 229/117.28 |
| 4,903,859 | A | 2/1990 | Derby et al. | |
| 5,143,283 | A * | 9/1992 | Lancaster | 229/199 |
| 5,209,364 | A * | 5/1993 | LaPoint, Jr. | 220/4.28 |
| 5,323,922 | A | 6/1994 | Lapoint, Jr. et al. | |
| 5,328,268 | A * | 7/1994 | Lafleur | 383/119 |
| 5,423,611 | A * | 6/1995 | Sherrard | 383/24 |
| 5,664,887 | A * | 9/1997 | LaFleur | 383/119 |
| 6,000,604 | A | 12/1999 | Lapoint, III | |
| 6,302,584 | B1 | 10/2001 | Derby et al. | |
| 6,305,567 | B1 * | 10/2001 | Sulpizio | 220/495.11 |
| 6,402,378 | B1 * | 6/2002 | Shackleton | 383/119 |

(Continued)

*Primary Examiner* — Anthony Stashick
*Assistant Examiner* — Andrew T Kirsch
(74) *Attorney, Agent, or Firm* — Pierce Atwood LLP

(57) ABSTRACT

A collapsible container defined by a continuous rigid structure and an integrated internal truss system. The continuous rigid structure is preferably four-sided such that it defines four continuous surfaces of a cube. The continuous rigid structure is collapsible due to at least one scoring line defined on at least one surface thereof. The internal truss system includes at least one inelastic member that is threaded through the surfaces of the continuous rigid structure to form a symmetrical and unitary support. A liner may be integrally affixed to each of the four sides and additionally provides a fifth side that forms the bottom of the container. A protective cover may be secured to the exterior of the continuous rigid structure for protecting the contained materials against the elements. The cover can be selectively sealed for rendering the container of the present invention substantially impervious to the elements.

13 Claims, 4 Drawing Sheets

U.S. PATENT DOCUMENTS

| | | | |
|---|---|---|---|
| 6,520,403 | B1 | 2/2003 | Lapoint, III |
| 2005/0029255 | A1 | 2/2005 | Rutledge |
| 2005/0082284 | A1 | 4/2005 | Ouyang |
| 2005/0098556 | A1 | 5/2005 | Kellerer |
| 2005/0274736 | A1 | 12/2005 | Provenza |
| 2006/0043090 | A1 | 3/2006 | Ferrini |
| 2006/0091154 | A1 | 5/2006 | Light |
| 2006/0144837 | A1 | 7/2006 | Linares |
| 2006/0144863 | A1 | 7/2006 | Reichert et al. |
| 2006/0162670 | A1 | 7/2006 | Axelrod et al. |
| 2006/0175328 | A1 | 8/2006 | Lapoint, III |

* cited by examiner

INTERNAL TRUSS SYSTEM FOR SEMI-RIGID CONTAINERS

BACKGROUND OF THE INVENTION

1. Field of the Invention

The present invention relates to containers for storing and/or transporting materials. More particularly, the present invention relates to semi-rigid collapsible containers that may be employed to transport bulk materials including, but not limited to, hazardous materials.

2. Discussion of Background Information

Metal containers are generally used to store and transport bulk materials, particularly hazardous materials. These metal containers are expensive to purchase, rent and store. They are fairly large and therefore require a considerable amount of space to maintain on site. That required space could be considerable, dependent upon the amount of material that must be stored and/or transported. While the storage volume of metal containers is considerable, the volume of material that is storable within multiple containers is diminished by the fact that the metal containers are generally cylindrical in nature. Cylinders generally cannot be oriented in a space-efficient manner. As such, there is a need in the art for containers that will contain a high volume of material and be storable in a low volume storage facility.

To meet this need, bag containers have been employed. Such bags take up much less space when not in use. However, such bags are of insufficient physical characteristics for transport purposes. That is, they are generally not tough enough to stand up to the rigors of movement by mechanical devices such as forklifts, accidental drops into cargo holds, stacking, and the like. Moreover, bag containers are easily deformed by the materials that they contain. As such, bag containers are not reliably stackable, and hence bag containers do not provide for efficient transport or storing of voluminous materials.

In order to overcome the limitations associated with flexible bags and rigid metal boxes, a series of semi-rigid containers have been developed. While these containers provide storage and transport benefits, they lack the rigidity and impermeability to contain a wide range of materials, such as hazardous materials. Therefore, what is needed is a rigid container for the storage and transport of bulk materials suitable for retaining a range of materials. What is also needed is a collapsible container that minimizes the exposure of the materials to the surrounding environment. Lastly, there is a need in the art for a collapsible container that can reliably hold its shape while stacked during storage and transport.

SUMMARY OF THE INVENTION

Accordingly, the present invention includes a collapsible container having an internal truss system for use in a variety of applications. The container of the present invention includes a continuous rigid structure that defines a plurality of sides. In an effort to minimize the space occupied by the container during storage, the continuous rigid structure is collapsible via a pair of scoring lines disposed on opposing surfaces. The continuous rigid structure is buttressed by an internal truss system that includes at least one inelastic member. The inelastic member is preferably composed of a synthetic material of a fixed length and dimension. The inelastic material is then threaded through the sides of the continuous rigid structure such that it provides a symmetric and rigid supporting structure for the scored surfaces of the continuous rigid structure.

As further described herein, the continuous rigid structure is preferably four-sided, such that it defines four continuous surfaces of a cube. In one embodiment, a liner is integrally affixed to each of the four sides and additionally provides a fifth side that forms the bottom of the container. A protective cover is secured to the exterior of the continuous rigid structure for protecting the contained materials against the elements.

The container of the present invention is selectively sealable via a pair of flaps that form part of the cover. The flaps are selectively attached to the exterior of the cover through a mechanical means, such as a loop and eyelet closure. In such a manner, the container can be easily and effectively sealed for stacking and transport without worry that the materials contained therein will be unnecessarily exposed to moisture and debris. The container of the present invention is also collapsible for storage and empty transport, as noted above.

The container of the present invention thus provides numerous benefits over the existing art. Namely, the internal truss system of the container of the present invention combines the benefits of a metal container with the adaptability of a semi-rigid container. Moreover, the liner and cover cooperate to render the container of the present invention substantially impervious to environmental damage that otherwise might harm the materials within.

The present invention is directed to a collapsible container includes a continuous rigid structure defining four sides, two of the four sides having a first scoring line and a second scoring line rendering the continuous rigid structure collapsible. Each of the four sides defining a first pair of passages and an inelastic member connecting the four sides such that the inelastic member passes through each of the first pair of passages within each of the four sides thus providing support for the continuous rigid structure.

The present invention is directed to a method of making a collapsible container that includes providing a four-sided continuous rigid structure wherein a first scoring line and a second scoring line are defined on opposing sides. The method includes providing an inelastic member having a first end and a second end. Collapsing the four-sided continuous rigid structure such that it is a substantially planar collapsed continuous rigid structure. Punching at least two passages through the collapsed continuous rigid structure, and threading an inelastic member through the at least two passages of the collapsed continuous rigid structure. Fastening the first end of the inelastic member to the second end of the inelastic member.

Further features and advantages of the present invention are described in detail below with reference to the following drawings.

DETAILED DESCRIPTION OF THE PREFERRED EMBODIMENTS

The present invention provides an internal truss system for a semi-rigid container that is sturdy enough for stacking, storing and transporting a variety of materials. In its preferred embodiments, the semi-rigid container of the present invention is collapsible. Therefore, unlike the ubiquitous metal containers, the container of the present invention can be collapsed from a substantially cubic volume into a substantially flat square for easy stacking and storage. The present invention thus provides numerous benefits to the user, as described more fully below with reference to the figures.

Figure 1:
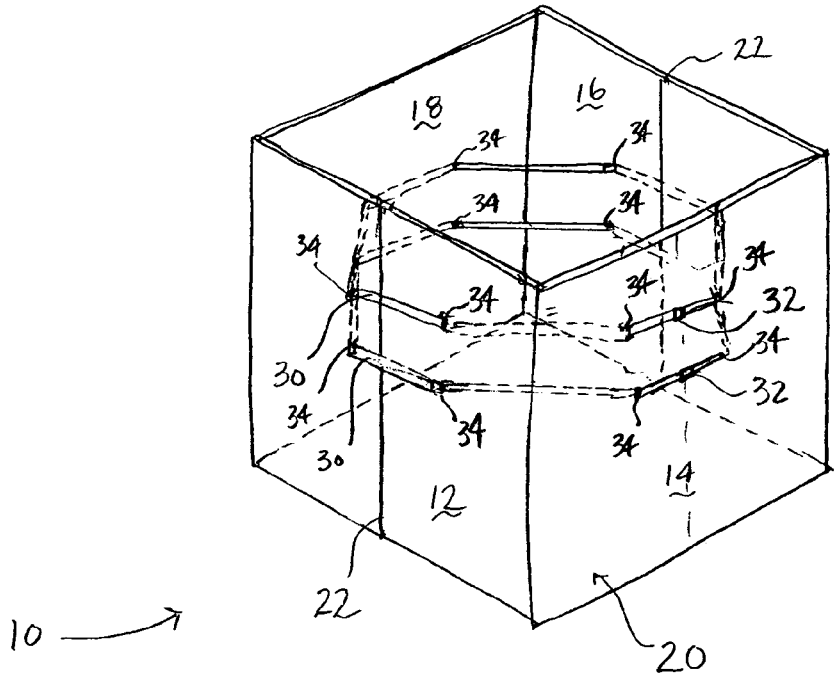
FIG. 1 is an elevated perspective view of the collapsible container of the present invention.

FIG. 1 is an elevated perspective view of the collapsible container 10 of the present invention. The container 10 preferably includes a first side 12, a second side 14, a third side 16 and a fourth side 18, all of which cooperate to define a substantially cubic volume therein. The plurality of sides 12, 14, 16, 18 preferably delineate a continuous rigid structure 20 that is formed from a semi-rigid material such as plastic, fiberboard or cardboard. In a preferred embodiment, the continuous rigid structure 20 is formed of cardboard such that it can be easily and economically produced while providing a substantial amount of rigidity as a containment device.

The continuous rigid structure 20 includes a pair of scoring lines 22 that are preferably disposed on opposing sides. For example, the scoring lines 22 may be disposed on the first side 12 and third side 16, or alternatively on the second side 14 and the fourth side 18. The scoring lines 22 are preferably disposed along the center of the respective sides thereby ensuring uniform and symmetrical folding attributes as described more fully below. That is, a scoring line disposed on the first side 12 will be disposed equidistant between the junction of the first side 12 and the second side 14 and the junction between the first side 12 and the fourth side 18, as illustrated in FIG. 1.

As the continuous rigid structure 20 is preferably comprised of a semi-rigid material as noted above, the collapsible container 10 of the present invention includes at least one inelastic member 30 that interconnects each respective side of the continuous rigid structure 20. As shown in FIG. 1, there are two inelastic members 30 that are interwoven between the four sides of the continuous rigid structure 20 in a symmetrical fashion so as to define a network of internal trusses between each of the four sides. In a preferred embodiment, each of the inelastic members 30 shown is formed from a single element that is connected to itself at an overlap 32. The inelastic members 30 are shown anchored to each of the four sides of the continuous rigid structure 20 by passing through a series of passages 34 that connect an inner surface of each of the four sides to an opposing outer surface. In such a manner, the internal truss system defined by the inelastic members 30 is integrated into the continuous rigid structure 20 thus forming the collapsible container 10.

Figure 2:
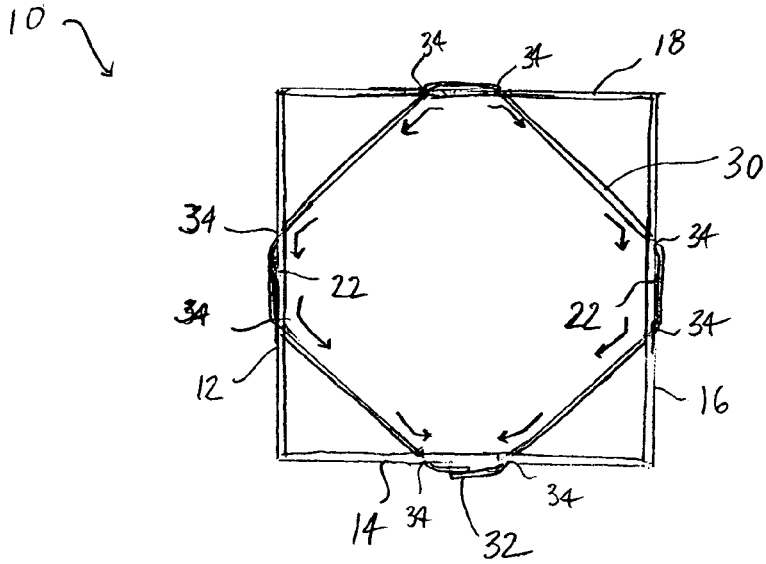
FIG. 2 is a plan view of the collapsible container of the present invention shown in FIG. 1.

FIG. 2 is a plan view of the collapsible container of the present invention shown in FIG. 1. As shown, the inelastic member 30 forms a substantially octagonal profile by alternating periods on the inside of the continuous rigid structure 20 with periods on the outer surfaces of the respective sides. The inelastic member 30 is shown disposed on the outer surface of the fourth side 18. Following the arrows in FIG. 2, the inelastic member 30 is then pressed through a pair of passages 34 on the fourth side 18, through which the inelastic member 30 is shown angling towards both the first side 12 and the third side 16. At the first side 12 and the third side 16, the inelastic member is pressed through a pair of passages 34, from which it angles towards the second side 14. Through another pair of passages 34 on the second side 14, the inelastic member 30 meets and is fastened to itself at the overlap 32.

In a preferred embodiment, the inelastic member 30 is of a length suitable for providing a tension between the four sides of the continuous rigid structure 20 such that the continuous rigid structure 20 maintains a substantially square shaped profile as shown in FIG. 2. Of particular concern is that the scoring lines 22 disposed on opposing sides of the continuous rigid structure 20 must be able to withstand a substantial load as the collapsible container 10 of the present invention is filled. As such, the inelastic member 30 is preferably composed of a material that is light, inelastic and easy to deform into the necessary profile for creating the internal truss system for the collapsible container 10. In preferred embodiments, the inelastic member 30 is polypropylene or polyester, although any other suitable synthetic, organic or inorganic polymer that can maintain its inelasticity under a load is suitable for use in the present invention.

Figure 3:
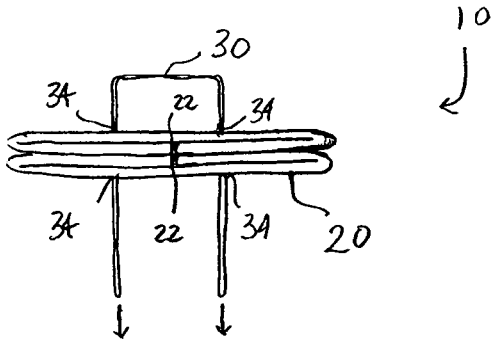
FIG. 3 is a plan view of the collapsible container of the present invention in an early step in a method of making the same.

FIG. 3 is a plan view of the collapsible container 10 of the present invention in an early step in a method of making the same. As shown, the collapsible container 10 is in a collapsed state in which it forms a substantially planar cross-section. By folding in along the scoring lines 22, a user can compress the continuous rigid structure 20 in an accordion-like manner for easy storage and transport when not in use.

In order to form the internal truss system described above, the planar continuous rigid structure 20 is perforated to form the plurality of passages 34, which pass continuously and symmetrically through each of the four sides of the continuous rigid structure 20. In a preferred embodiment, the plurality of passages 34 are formed by a pressing machine adapted to thread the inelastic member 20 through the passages 34 as it creates them. Alternatively, the process of forming the plurality of passages 34 and the placement of the inelastic member 30 therein may be performed manually. As discussed further below, it is also conceived that the continuous rigid structure 20 of the present invention will be lined on its interior surfaces, in which case it is desirable to fit the liner into the continuous rigid structure 20 prior to threading the inelastic members 30 through the plurality of passages.

Figure 4:
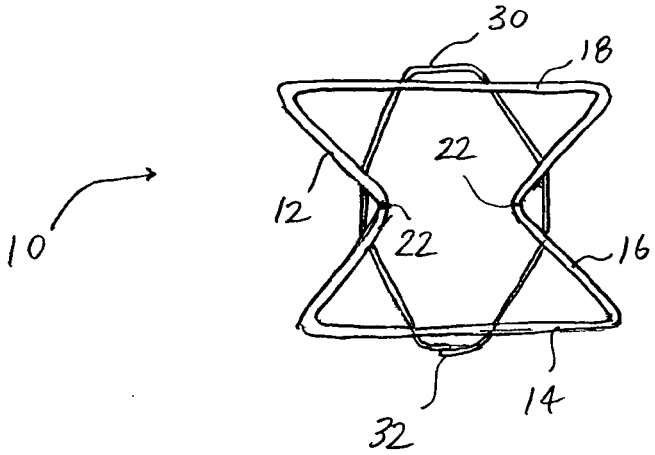
FIG. 4 is a plan view of the collapsible container of the present invention in an intermediate step in a method of making the same.

FIG. 4 is a plan view of the collapsible container of the present invention in an intermediate step in a method of making the same. In FIG. 4, the inelastic member 30 is shown fastened to itself at the overlap 32. The means for fastening the inelastic member 30 to itself may include mechanical devices, adhesives and other bonding techniques. For example, the inelastic member 30 may be fasted to itself using staples, epoxies or resins. Preferably, however, the means for fastening will be an automated process such as sonic welding, which is particularly well suited to bonding materials composed of synthetic polymers such as polypropylene and polyester. As shown in FIG. 4, the overlap 32 of the inelastic member 30 is located near the outer surface of the second side 14. While it is understood that the overlap 32 can be located at any point along the continuum of the inelastic member 30, it is preferred that it be located near the outer surface of a side of the continuous rigid structure 20 that does not have a scoring line 22.

Figure 5:
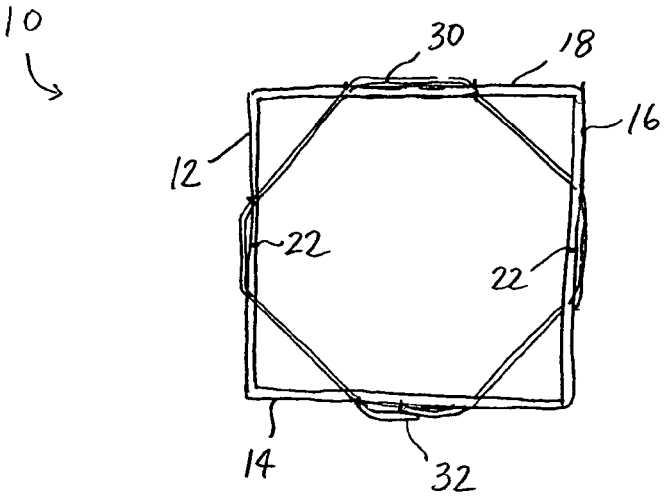
FIG. 5 is a plan view of the collapsible container of the present invention in a later step in a method of making the same.

FIG. 5 is a plan view of the collapsible container of the present invention in a later step in a method of making the same. As noted before, the inelastic member 30 is preferably of a single length of material that, when stretched to its limit, will maintain the substantially square profile of the continuous rigid structure 20. In particular, when a load is placed upon the inner surfaces of the continuous rigid structure 20, the sides of the continuous rigid structure 20 that have the scoring lines 22 therein will not bow or deform in an outward direction. However, as previously noted, the inelastic member 30 will permit the inward folding of the continuous rigid structure along the scoring lines 22, thus allowing a user to collapse the continuous rigid structure 20 into a substantially planar form as shown in FIG. 3.

Figure 6:
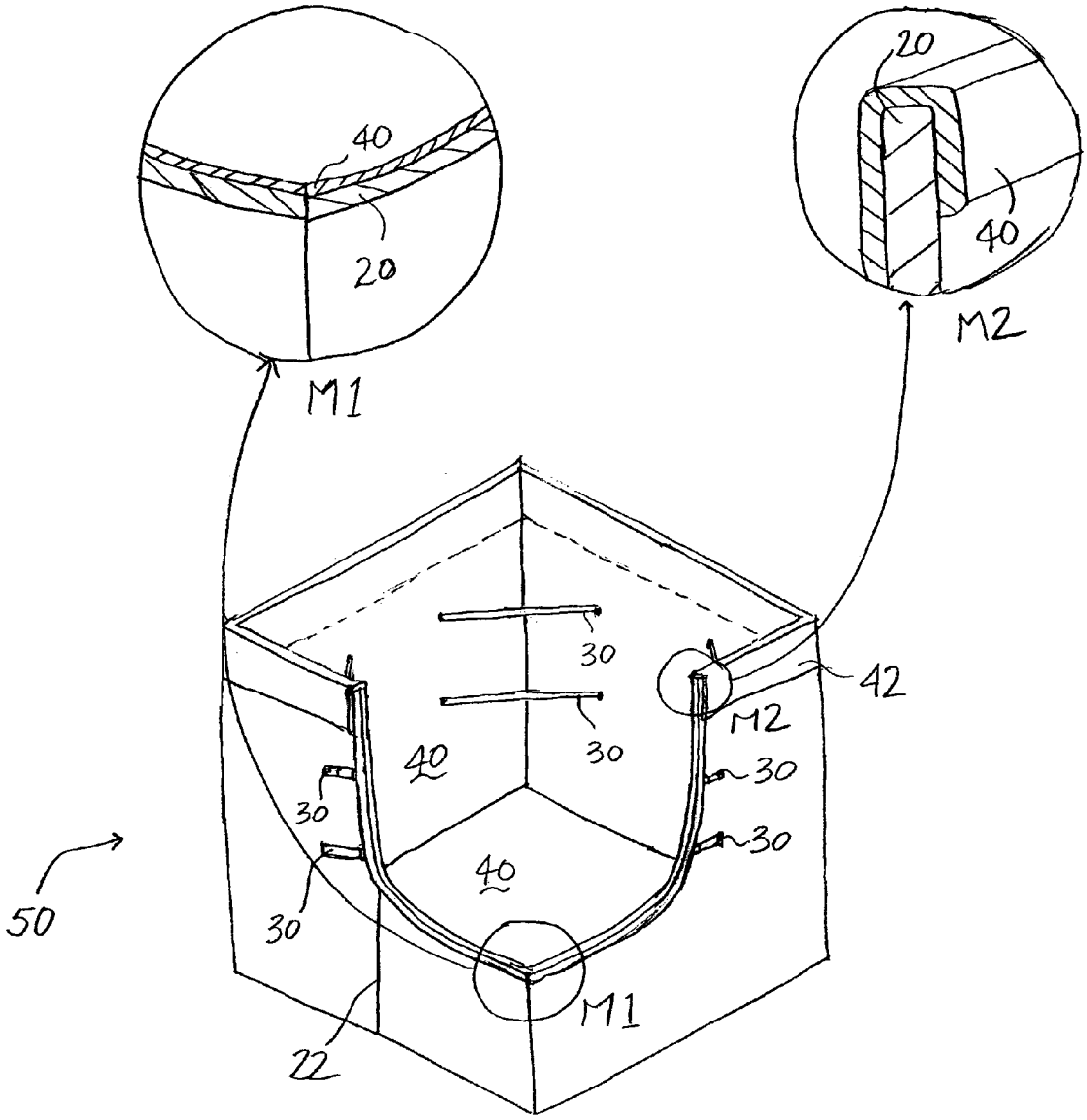
FIG. 6 is an elevated partial cut-away perspective view of a collapsible container in accordance with an alternate embodiment of the present invention.

FIG. 6 is an elevated partial cut-away perspective view of a collapsible container in accordance with an alternate embodiment of the present invention. As noted above, the present invention may incorporate a liner 40 that is uniformly affixed to the interior surfaces of the continuous rigid structure 20. In a preferred embodiment, the liner 40 is sufficiently large to include a top portion 42 that can be folded over and affixed to the outer surfaces of the continuous rigid structure 20, as shown in magnified portion M2. As previously noted, the liner 40 will incorporate the passages 34 through which the inelastic structure 30 passes, as it is preferred to affix the liner to the continuous rigid structure 20 prior to assembling the internal truss of the present invention.

The liner 40 preferably includes a fifth surface that forms the bottom portion of the container 10. The liner 40 is preferably form-fitted to the four sides 12, 14, 16, 18 of the continuous rigid structure 20 and uniformly affixed thereto by glue, epoxy, resin or any other adhesive that is known in the art. The liner 40 is affixed to the four sides 12, 14, 16, 18 in such a manner so as to render it coplanar with each of the four sides 12, 14, 16, 18. That is, the liner 40 is affixed to substantially all of the interior surfaces of the respective four sides 12, 14, 16, 18, as shown in magnified portion M1. As the liner 40 also includes the bottom portion, the liner 40 and four sides 12, 14, 16, 18 define five sides of a substantially symmetric cubic structure. The liner 30 is preferably composed of a water resistant or water proof synthetic material that is also resistive to degradation by temperature and corrosive compounds.

Figure 7:
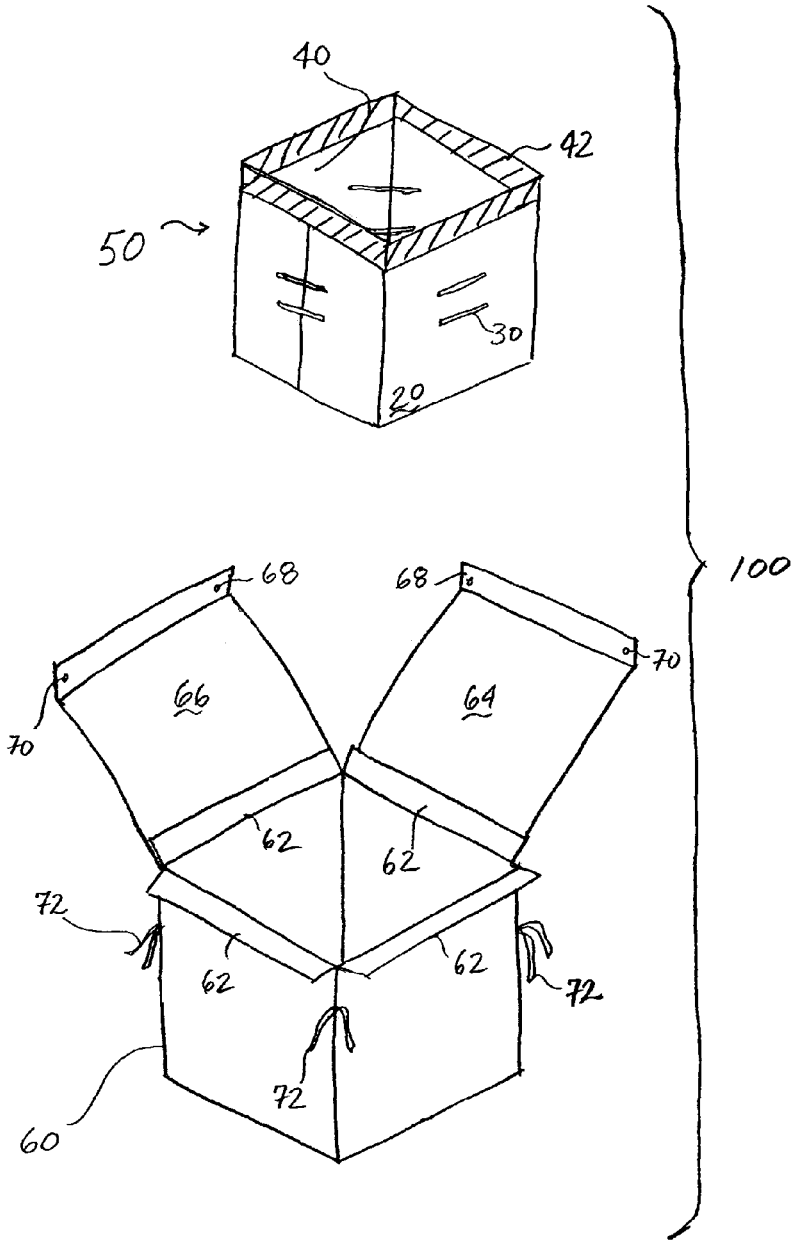
FIG. 7 is an exploded perspective view of a collapsible container in accordance with an alternate embodiment of the present invention.

The continuous rigid structure 20, inelastic member 30 and liner 40 can be utilized as an integrated unit as shown further in FIG. 7, which is an exploded perspective view of a covered collapsible container 100 in accordance with an alternate embodiment of the present invention. As shown, the continuous rigid structure 20, inelastic member 30 and liner 40 form a lined semi-rigid container 50 that may be utilized on its own for the storage and transport of various types of materials. In another embodiment, the lined semi-rigid container 50 may be disposed within a cover 60 that fully encloses and encapsulates both the lined semi-rigid container 50 and its contents.

The cover 60 defines a substantially cubic form that is disposed over the lined semi-rigid container 50. The cover 60 further defines a bottom (not visible), as well as two flaps 64, 66 that, in use, cooperate to enclose the contents of the container 100. The cover 60 also includes a plurality of tabs 62 that may be fixed to the interior of the four sides 12, 14, 16, 18 of the lined semi-rigid container 50 for securing the cover 60 thereto. The plurality of tabs 62 may be so affixed by glue, epoxy, resin or any other adhesive that is known in the art.

The flaps 64, 66 include at least one end portion 68 for selectively engaging the cover 60 of the container 100, thereby securing its contents. Any conventional and secure fastening means may be used to secure an end portion 68 of a flap 64,66 to a corresponding portion of the cover 60. For example, the end portions 68 may include a plurality of eyelets 70 that are adapted for receiving a plurality of ties 72 disposed on the exterior of the cover 60. The user may encapsulate the container 100 by folding flaps 64, 66 down over the cavity of the container 100 and affixing the end portions 68 to the plurality of ties 72 through the eyelets 70. As the cover 60 is preferably composed of a water resistant or waterproof material, the user can substantially insulate the container 100 against all kinds of moisture and corrosive elements by closing the flaps 64, 66 in the manner described above. It should be understood that the eyelet-tie mechanism is only one means by which the container 100 may be closed, and other similar mechanisms for selectively affixing two objects are regarded as equivalent to those described herein.

The container 10, 100 of the present invention as described herein provides a number of tangible benefits over the existing rigid and semi-rigid containers known in the art. The container of the present invention is rigid enough for stacking, storing and transporting a variety of materials that other semi-rigid containers cannot handle. Through the incorporation of the inelastic members, an internal truss structure is described that provides the strength and rigidity of the less-desirable metal containers. Moreover, unlike the rigid metal containers, the container 10, 100 of the present invention can be collapsed from a substantially cubic volume into a substantially flat square for easy stacking and storage.

It should be apparent to those skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

I claim:

1. A collapsible industrial shipping container comprising:

a continuous rigid structure defining four planar sides, two of the four planar sides including a first scoring line and a second scoring line rendering the continuous rigid structure collapsible, each of the four sides defining a first pair of passages;

a liner that is form fitted and uniformly adhesively affixed across substantially all of each interior surface of the four planar sides of the continuous rigid structure prior to formation of the first pair of passages and that comprises a top portion that folds over and affixes to each exterior surface of the four sides of the continuous rigid structure;

an inelastic member connecting the four planar sides such that the inelastic member passes through each of the first pair of passages within each of the four planar sides thus providing support for the continuous rigid structure and maintaining a square profile of the lined continuous rigid structure when under tension; and a stand-alone cover disposed about the exterior of the continuous rigid structure, wherein the stand-alone cover encapsulates the lined continuous rigid structure and defines a substantially cubic form, and wherein the cover comprises a plurality of tabs that are folded over into the interior of the lined continuous rigid structure and affixed to the interior of the four planar sides of the lined four-sided continuous rigid structure.

2. The collapsible container of claim 1 wherein each of the four planar sides further defines a second pair of passages.

3. The collapsible container of claim 2 further comprising a second inelastic member connecting the four sides such that the second inelastic member passes through each of the second pair of passages within each of the four planar sides.

4. The collapsible container of claim 1 wherein the inelastic member is comprised of polypropylene or polyester.

5. The collapsible container of claim 1 wherein the inelastic member is polypropylene.

6. The collapsible container of claim 1 wherein the inelastic member is polyester.

7. The collapsible container of claim 1 wherein the inelastic member is comprised of a single length of material that is fastened to itself to form a continuous member.

8. The collapsible container of claim 7 wherein the inelastic member is sonic welded to itself to form a continuous member.

9. The collapsible container of claim 3 wherein the second inelastic member is comprised of polypropylene or polyester.

10. The collapsible container of claim 9 wherein the second inelastic member is comprised of polypropylene.

11. The collapsible container of claim 9 wherein the second inelastic member is polyester.

12. A method of making a collapsible industrial shipping container comprising:

providing a four-sided continuous rigid structure comprising four planar sides wherein a first scoring line and a second scoring line are defined on opposing planar sides;

lining an interior surface of the four-sided continuous rigid structure with a liner, wherein the liner is form fitted to the interior surface so that the liner is coplanar with each of the four planar sides of the interior surface;

adhesively affixing the liner to substantially all of each interior surface of the four planar sides;

folding over a top portion of the liner so that the top portion affixes to the four planar sides of the outer surface of the continuous rigid structure;

providing an inelastic member having a first end and a second end;

collapsing the lined four-sided continuous rigid structure such that it is a substantially planar collapsed continuous rigid structure;

punching at least two passages through the collapsed continuous rigid structure and liner affixed thereto;

threading an inelastic member through the at least two passages of the collapsed continuous rigid structure;

fastening the first end of the inelastic member to the second end of the inelastic member such that the inelastic member maintains a square profile of the lined continuous rigid structure when under tension; and covering the exterior of the lined four-sided continuous rigid structure with a stand-alone cover, wherein the stand-alone cover encapsulates the lined continuous rigid structure and defines a substantially cubic form, and wherein the cover comprises a plurality of tabs that are folded over into the interior of the lined continuous rigid structure and affixed to the interior of the four planar sides of the lined four-sided continuous rigid structure.

13. The method of claim 12 further comprising the steps of:

providing a second inelastic member having a first end and a second end;

threading the second inelastic member through the at least two passages of the collapsed continuous rigid structure; and fastening the first end of the second inelastic member to the second end of the second inelastic member.

* * * * *